US007849915B2

(12) United States Patent
Kawakubo et al.

(10) Patent No.: US 7,849,915 B2
(45) Date of Patent: Dec. 14, 2010

(54) HEAT EXCHANGE TUBE HAVING MULTIPLE FLUID PATHS

(75) Inventors: Masaaki Kawakubo, Obu (JP); Etsuo Hasegawa, Nagoya (JP); Yoshiki Katoh, Chita-gun (JP); Ken Muto, Toyota (JP)

(73) Assignee: Denso Corporation, Kariya (JP)

( * ) Notice: Subject to any disclaimer, the term of this patent is extended or adjusted under 35 U.S.C. 154(b) by 1210 days.

(21) Appl. No.: 10/850,596

(22) Filed: May 19, 2004

(65) Prior Publication Data

US 2004/0251013 A1 Dec. 16, 2004

(30) Foreign Application Priority Data

May 23, 2003 (JP) ..... 2003-146661

(51) Int. Cl.
*F28F 1/00* (2006.01)

(52) U.S. Cl. ..... 165/177; 29/890.03

(58) Field of Classification Search ..... 165/177; 29/890.03

See application file for complete search history.

(56) References Cited

U.S. PATENT DOCUMENTS

| | | | | |
|---|---|---|---|---|
| 6,000,467 | A * | 12/1999 | Tokizaki et al. | 165/177 |
| 6,216,776 | B1 * | 4/2001 | Kobayashi et al. | 165/177 |
| 6,340,055 | B1 * | 1/2002 | Yamauchi et al. | 165/175 |
| 6,357,522 | B2 | 3/2002 | Dienhart et al. | |
| 6,907,922 | B2 * | 6/2005 | Katoh et al. | 165/177 |
| 6,935,414 | B2 * | 8/2005 | Kawakubo et al. | 165/177 |
| 7,059,399 | B2 * | 6/2006 | Chin et al. | 165/177 |
| 7,080,683 | B2 * | 7/2006 | Bhatti et al. | 165/177 |
| 2001/0004935 | A1 * | 6/2001 | Sanada et al. | 165/177 |
| 2002/0050337 | A1 * | 5/2002 | Kaspar et al. | 165/177 |
| 2002/0070012 | A1 * | 6/2002 | Kraft | 165/177 |
| 2003/0066636 | A1 * | 4/2003 | Kawakubo et al. | 165/177 |

FOREIGN PATENT DOCUMENTS

| | | |
|---|---|---|
| DE | 199 06 289 A1 | 8/1999 |
| DE | 198 45 336 A1 | 4/2000 |
| DE | 102 46 849 A1 | 4/2003 |
| JP | 2000-356488 | 12/2000 |

OTHER PUBLICATIONS

Office Action issued from German Patent Office dated Aug. 21, 2008 in the corresponding German Patent Application No. 102004024825.7.

* cited by examiner

*Primary Examiner*—Ljiljana (Lil) V Ciric
(74) *Attorney, Agent, or Firm*—Harness, Dickey & Pierce, PLC

(57) ABSTRACT

A heat exchange tube having a flat shape includes a plurality of fluid paths having a circular cross section and extending in a longitudinal direction of the tube. Each fluid path is parallel to each other fluid path. The tube is dimensioned such that a distance between two adjacent fluid paths is defined as Wt, and a circumferential thickness between a surface of the tube and an outermost fluid path is defined as Ht. The distance Wt and the circumferential thickness Ht have a relationship as $0.42 \leqq Ht/Wt \leqq 0.98$.

14 Claims, 4 Drawing Sheets

HEAT EXCHANGE TUBE HAVING MULTIPLE FLUID PATHS

CROSS REFERENCE TO RELATED APPLICATION

This application is based on Japanese Patent Application No. 2003-146661 filed on May 23, 2003, the disclosure of which is incorporated herein by reference.

FIELD OF THE INVENTION

The present invention relates to a heat exchange tube having multiple fluid paths. The heat exchange tube is suitably used for a heat exchanger in a vapor-compression refrigerant cycle.

BACKGROUND OF THE INVENTION

A heat exchanger is used for a vapor-compression refrigerant cycle. Specifically, the heat exchanger is used for an air conditioner in an automotive vehicle. In the air conditioner, the heat exchanger works as a condenser. As shown in FIGS. 8 and 9, a multi-flow type heat exchanger 10 is used in the air conditioner. The heat exchanger 10 includes a pair of headers 3, multiple heat exchange tubes 1, a fin 4 and a side plate 5. The headers 3 are disposed along with a vertical direction of the heat exchanger 10. The heat exchange tubes 1 are disposed in parallel between the headers 3. Both ends of each heat exchange tube 1 are connected to the headers 3, respectively. The fin 4 is disposed between the heat exchange tubes 1. The fin 4 is further disposed outside of the outermost heat exchange tube 1. The side plate 5 is disposed outside of the outermost fin 4.

A separation member 6 is disposed in the header 3 so that the heat exchange tubes 1 are divided into multiple parts P1-P3. Refrigerant is introduced into the heat exchanger 10 from an inlet 7 of the header 3 disposed upper side of the header 3. Then, the refrigerant flows through the parts P1-P3, respectively. While the refrigerant flows through the parts P1-P3, heat is exchanged between the refrigerant in the heat exchange tubes 1 and the outside air outside of the heat exchanger 10 so that the refrigerant is condensed and liquefied. Then, the liquefied refrigerant flows out of the heat exchanger 10 from an outlet 8 of the header 3 disposed under the header 3. The heat exchange tube 1 of the heat exchanger 10 is made of, for example, aluminum. The heat exchange tube 1 is formed by an extrusion method to be flattened. The heat exchange tube 1 includes multiple fluid paths. Each fluid path extends in a longitudinal direction and disposed in parallel in a latitudinal direction, as shown in FIG. 9.

In general, the refrigerant in the air conditioner is, for example, hydro chloro fluoro carbon (i.e., HCFC), or hydro fluoro carbon (i.e., HFC). It is already decided to prohibit using the HCFC refrigerant by year 2020. This is because the HCFC is one of ozone-layer-destroying materials. Further, the HFC refrigerant is one of greenhouse gases. Therefore, the HFC is also strictly limited from discharging to the atmosphere. Thus, alternative materials of chloro fluoro carbon such as the HCFC refrigerant or the HFC refrigerant is required to develop. Specifically, it is required to develop a new technique using the alternative materials.

Recently, carbon dioxide (i.e., $CO_2$) is considered as one of alternative materials. Specifically, the $CO_2$ refrigerant is used in the vapor-compression refrigerant cycle. The $CO_2$ gas is one of natural gasses in nature. Therefore, the $CO_2$ gas does not affects on the global environment substantially compared with the chrolo fluoro carbon.

However, when the $CO_2$ refrigerant is used as the refrigerant in the vapor-compression refrigerant cycle, the $CO_2$ refrigerant has comparatively high pressure in regular use. This is because the refrigerant cycle becomes a super critical refrigerant cycle because of specific thermodynamic properties of the $CO_2$ gas. Therefore, for example, the pressure of the $CO_2$ refrigerant in regular use on a high-pressure side of the refrigerant cycle becomes higher than 10 Mpa. Here, the pressure of the chloro fluoro carbon refrigerant has comparatively low pressure in regular use. The pressure of the chloro fluoro carbon refrigerant is, for example, 3 MPa or 4 MPa. Thus, in a case where the $CO_2$ refrigerant is used as the refrigerant in the refrigerant cycle, it is required to secure the high mechanical strength of the heat exchange tube. Specifically, the heat exchange tube is required to have the withstand pressure three times or more higher than the pressure in regular use on the high-pressure side. That is, the withstand pressure of the heat exchange tube is required to be about 30 MPa or 40 MPa.

A heat exchange tube having high withstand pressure is, for example, disclosed in Japanese Patent No. 3313086 (i.e., Japanese Patent Application Publication No. 2000-356488). A fluid path of the heat exchange tube has a rectangular cross section with a rounding corner. Further, thickness of a sidewall of the heat exchange tube becomes thicker.

However, it is preferred that the fluid path has a perfect circular cross section in view of the withstand pressure of the heat exchange tube. Further, it is difficult to define the withstand pressure on the basis of only a ratio between the thickness of the heat exchange tube and the width of the fluid path. This is because the heat exchange tube can be made of one of various materials having high mechanical strength. Each material has a different mechanical strength. Therefore, it is difficult to estimate the withstand pressure of the heat exchange tube.

SUMMARY OF THE INVENTION

In view of the above-described problem, it is an object of the present invention to provide a heat exchange tube with multiple fluid paths having a perfect circular cross section and having high withstand pressure.

A heat exchange tube having a flat shape includes a plurality of fluid paths having a perfect circular cross section and extending in a longitudinal direction of the tube. Each fluid path is parallel together. The tube has a certain dimensions in such a manner that a distance between two adjacent fluid paths is defined as Wt, and a circumferential thickness between a surface of the tube and an outmost fluid path is defined as Ht. The distance Wt and the circumferential thickness Ht have a relationship as $0.42 \leqq Ht/Wt \leqq 0.98$.

In the above heat exchange tube, the fluid paths have a perfect circular cross section, and the tube has sufficient high withstand pressure. Further, the weight of the tube becomes light.

Preferably, the fluid paths are aligned in a line along with a latitudinal direction of the tube. More preferably, the tube includes a circumferential surface having a concavity and a convexity corresponding to the fluid path.

Preferably, the fluid paths are aligned in multiple lines along with a latitudinal direction of the tube, and two adjacent fluid paths disposed in two adjacent lines, respectively, are disposed alternately. More preferably, the tube includes an circumferential surface having a concavity and a convexity corresponding to the fluid path.

Preferably, the tube is used for a high-pressure side heat exchanger in a vapor-compression refrigerant cycle with $CO_2$ refrigerant. The fluid path has a diameter defined as Dp, and the tube is made of material having a tensile strength defined as S. The relationship among the distance Wt, the tensile strength S and the diameter Dp is defined as $(0.73-0.0036\times S)\times Dp \leqq Wt \leqq (1.69-0.0084\times S)\times Dp$ . More preferably, the tensile strength S is in a range between 50 $N/mm^2$ and 130 $N/mm^2$, and wherein the tube is made of aluminum based material. Furthermore preferably, the diameter Dp is in a range between 0.4 mm and 2.0 mm.

Preferably, the tube is used for a low-pressure side heat exchanger in a vapor-compression refrigerant cycle with $CO_2$ refrigerant. The fluid path has a diameter defined as Dp, and the tube is made of material having a tensile strength defined as S. The relationship among the distance Wt, the tensile strength S and the diameter Dp is defined as $(0.34-0.0024\times S)\times Dp+0.06 \leqq Wt \leqq (0.80-0.0056\times S)\times Dp+0.14$.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF THE PREFERRED EMBODIMENTS

First Embodiment

Figure 1A:
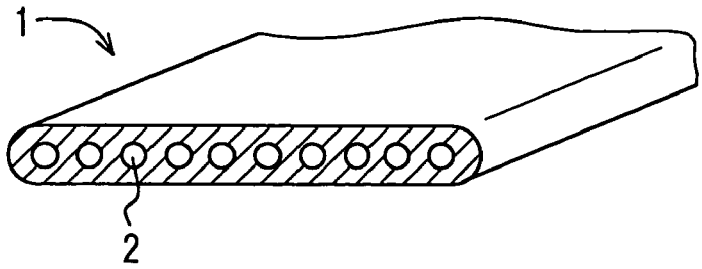
FIG. 1A is a schematic perspective view showing a heat exchange tube.
Figure 1B:
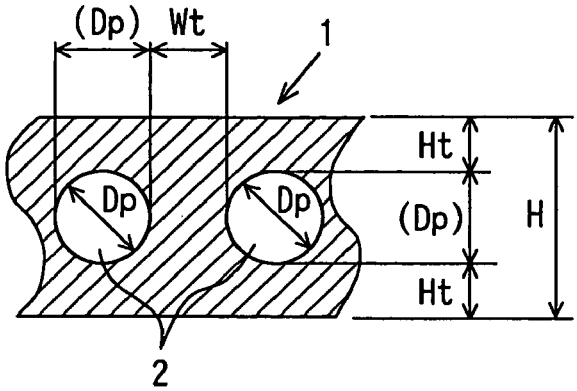
FIG. 1B is a partially enlarged cross sectional view showing the heat exchange tube according to a first embodiment of the present invention.

A heat exchange tube 1 having multiple fluid paths 2 according to a first embodiment of the present invention is shown in FIGS. 1A and 1B. The heat exchange tube 1 is suitably used for a heat exchanger in a vapor-compression refrigerant cycle. Specifically, the heat exchange tube 1 is used in a heat exchanger in a vapor-compression refrigerant cycle having comparatively high-pressure refrigerant such as carbon dioxide. The heat exchange tube 1 is used in the heat exchanger such as a multi-flow type heat exchanger or a parallel flow type heat exchanger. The fluid paths 2 of the heat exchange tube 1 flow the refrigerant having high temperature, extend in a longitudinal direction of the tube 1, have perfect circular cross sections, respectively, and are parallel each other in a latitudinal direction of the tube 1. The fluid paths are aligned in a line in the tube 1.

The heat exchange tube 1 is made of aluminum having long length and formed by an extrusion method. The heat exchange tube 1 is formed to be flattened, and has the fluid path 2 having a perfect circular cross section. The fluid path 2 extends in the longitudinal direction of the heat exchange tube 1. Multiple fluid paths 2 are disposed in parallel in the latitudinal direction of the tube 1. As shown in FIG. 1B, the width of a separation portion between the fluid paths 2 (i.e., the distance between the fluid paths 2) is represented as Wt millimeters. The thickness of the tube 1 is represented as Ht millimeters. The thickness of the tube 1 is disposed outer circumference of the tube 1, i.e., the thickness is disposed between the fluid path 2 and the circumference of the tube 1. The diameter of the fluid path 2 is represented as Dp millimeters. The total thickness (i.e., the height) of the tube 1 is represented as H millimeters. The tensile strength of the material composing the tube 1 is S $N/mm^2$.

The distance Wt is defined as follows. In case of the heat exchanger disposed on the high-pressure side, the optimum distance Wt of the tube 1 disposed on the high-pressure side is defined as:

$$Wt=(1.21-0.006\times S)\times Dp.$$

In case of the heat exchanger disposed on the low-pressure side, the optimum distance Wt of the tube 1 disposed on the low-pressure side is defined as:

$$Wt=(0.57-0.004\times S)\times Dp+0.1.$$

The optimum relationship between the thickness Ht of the tube 1 and the distance Wt is such that:

$$Ht:Wt=0.7:1.0 \text{ (i.e., } Ht/Wt=0.7).$$

Here, the total thickness H of the tube 1 is defined as:

$$H=Dp+2\times Ht.$$

Figure 2:
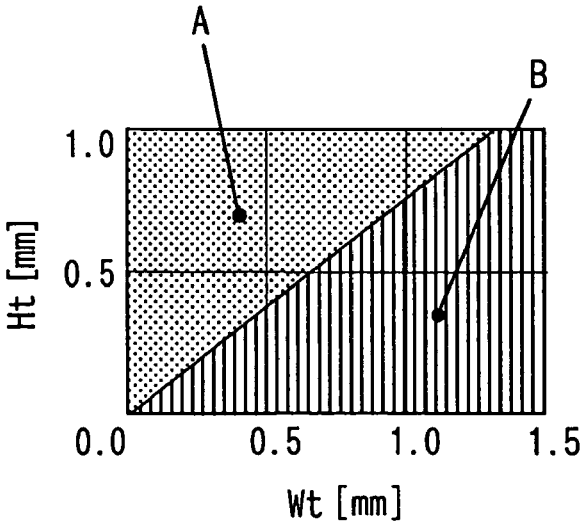
FIG. 2 is a graph showing a place where the maximum stress is generated in the heat exchange tube, according to the first embodiment.

The above optimum distances and the optimum relationship are obtained as follows. The stress in the tube 1 having different thicknesses Ht and distances Wt is numerically analyzed. As a result, the thickness Ht and the distance Wt have the relationship shown in FIG. 2. In FIG. 2, a region A represents the tube 1 having a portion disposed between the fluid paths 2, the portion in which the maximum stress is generated. That is, the maximum stress is generated in the portion of the tube 1 shown as Wt in FIG. 1B (i.e., the portion of the tube 1 is a partition portion). A region B represents the tube 1 having another portion disposed between the fluid path 2 and the circumference of the tube 1, the other portion in which the maximum stress is generated. That is, the maximum stress is generated in the other portion of the tube 1 shown as Ht in FIG. 1B (i.e., the other portion of the tube 1 is a circumferential portion). Thus, FIG. 2 shows the portion, in which the maximum stress is generated. The stress is generated by inner pressure of the fluid in the tube 1.

In the region A in FIG. 2, even if the thickness Ht of the circumferential portion becomes thicker, the maximum stress is generated in the partition portion. Therefore, a crack or a break may be generated from the partition portion. On the other hand, in the region B in FIG. 2, even if the distance Wt, i.e., thickness of the partition portion becomes thicker, the maximum stress is generated in the circumferential portion. Therefore, a crack or a break may be generated from the circumferential portion.

In view of the above relationship between the thickness Ht and the distance Wt, the tube 1 is designed to have the maximum withstand pressure effectively. Specifically, when the ration of Ht/Wt is set to be an optimum value so that the stress generated in the partition portion is almost equal to the stress generated in the circumferential portion, the tube 1 has the maximum withstand pressure. On the basis of the result shown in FIG. 2, the optimum value of the ratio of Ht/Wt is defined as:

$$Ht:Wt=0.7:1.0 \text{ (i.e., } Ht/Wt=0.7).$$

This optimum value is independent from the diameter Dp of the fluid path 2 and the tensile strength S of the material composing the tube 1. This is confirmed by the analysis of the stress in the tube 1 having different thicknesses Ht and distances Wt. The distance Wt between the fluid paths 2 and the thickness Ht of the tube 1 are determined with holding the optimum value of the ration of Ht/Wt, so that the tube 1 has a sufficient withstand pressure and becomes light weight.

Figure 3:
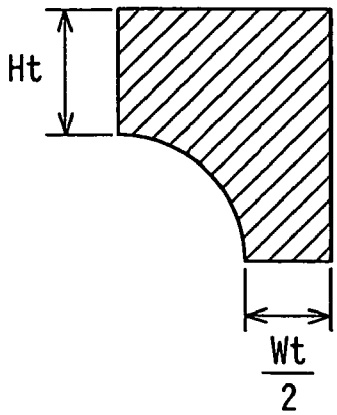
FIG. 3 is a part of a cross sectional view showing a simulation model of the heat exchange tube for simulating the stress in the heat exchange tube, according to the first embodiment.
Figure 4:
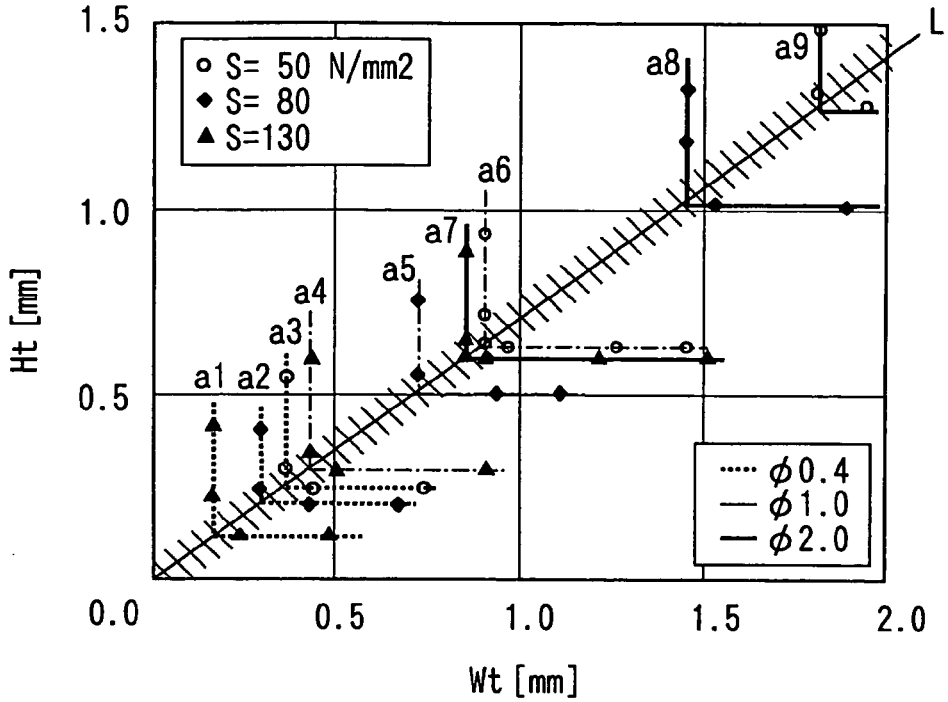
FIG. 4 is a graph showing a place where the maximum stress is generated in the heat exchange tube disposed on the high-pressure side in a $CO_2$ refrigerant cycle, according to the first embodiment.

The result of the analysis of the stress is described in detail as follows. In the stress analysis, a quarter part of the tube 1 as a simulating model is assumed, as shown in FIG. 3. The parameters of the analysis are the tensile strength S, the diameter Dp, the distance Wt, the thickness Ht, and the inner pressure P. FIG. 4 shows the result of the stress analysis. FIG. 4 is similar to FIG. 2. In FIG. 4, the tube 1 is applied with the inner pressure of 40 MPa. In FIG. 4, for example, a solid line a7 represents the relationship between the thickness Ht and the distance Wt in the tube 1 having the diameter Dp of 2.0 mm and the tensile strength S of 130 N/min, when the inner pressure of 40 MPa is applied to the tube 1. Specifically, when the thickness Ht and the distance Wt are disposed on a part of the solid line a7 disposed upside of an optimum ratio line L, the crack or the break is generated from the partition portion disposed between the fluid paths 2. That is, even if the thickness Ht of the circumferential portion becomes thicker, the crack or the break is generated from the partition portion. On the other hand, when the thickness Ht and the distance Wt are disposed on another part of the solid line a7 disposed downside of the optimum ratio line L, the crack or the break is generated from the circumferential portion disposed between the fluid path 2 and the circumference of the tube 1. That is, even if the distance Wt between the fluid paths 2 becomes larger, the crack or the break is generated from the circumferential portion.

Specifically, when the distance Wt is equal to or larger than 0.9 mm in a case where the thickness Ht is about 0.63 mm, the crack is generated from the circumferential portion. When the thickness Ht is equal to or larger than 0.63 mm in a case where the distance Wt is about 0. 9 mm, the crack is generated from the partition portion.

Therefore, the solid line a7 represents a limitation line of the withstand pressure. That is, when the tube 1 has the thickness Ht and the distance Wt, which are disposed on the right upper side from the solid line a7, the tube 1 can bear the inner pressure of 40 MPa.

Thus, the intersection between the part and the other part of the solid line a7 is obtained. The intersection represents that the thickness Ht is 0.63 mm, and the distance Wt is 0.9 mm. When the tube 1 has the thickness Ht of 0.63 mm and the distance Wt of 0.9 mm, the crack is generated from the partition portion or the circumferential portion, i.e., the withstand pressure of the partition portion is substantially equal to that of the circumferential portion. Each intersection of lines a1-a9 is connected together so that the optimum ratio line L is obtained. Here, the optimum ratio line represents the optimum ratio of Ht/Wt=0.7. As a result, even when the diameter Dp and/or the tensile strength S are changed, the withstand pressure of the partition portion is substantially equal to that of the circumferential portion in a case where the optimum ratio of Ht/Wt is 0.7.

Here, in FIG. 4, the dotted lines a1-a3 represent the tube 1 having the diameter Dp of 0.4 mm. The dashed lines a4-a6 represent the tube 1 having the diameter Dp of 1.0 mm. The solid lines a7-a9 represent the tube 1 having the diameter Dp of 2.0 mm. Also, in FIG. 4, the open circle represents the tube 1 having the tensile strength S of 50 N/mm$^2$. The closed square represents the tube 1 having the tensile strength S of 80 N mm$^2$. The closed triangle represents the tube 1 having the tensile strength S of 130 N/mM$^2$.

Figure 5:
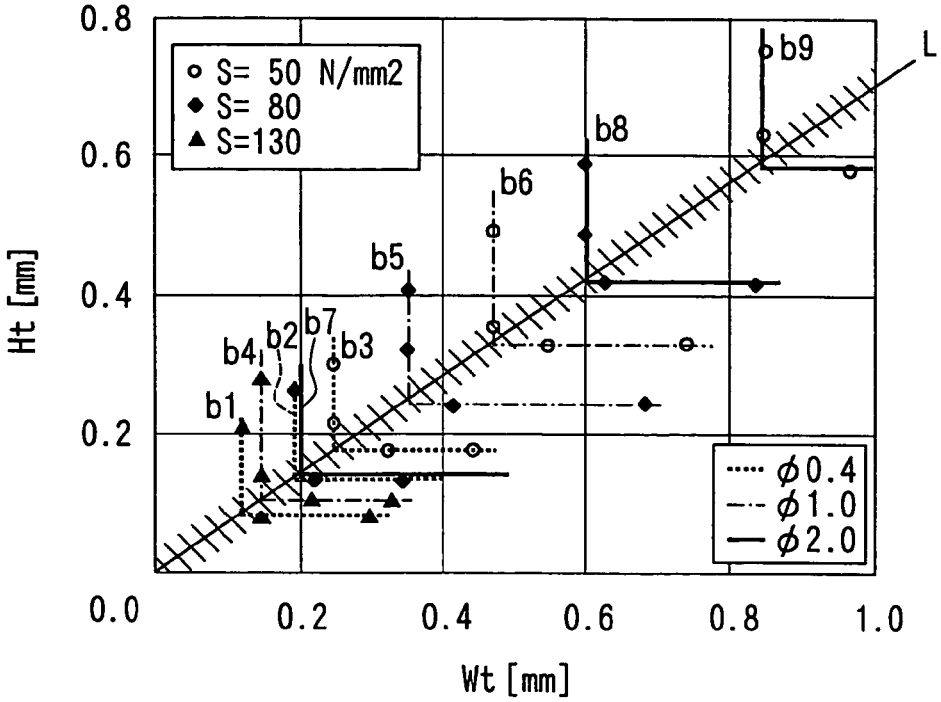
FIG. 5 is a graph showing a place where the maximum stress is generated in the heat exchange tube disposed on the low-pressure side in the $CO_2$ refrigerant cycle, according to the first embodiment.

FIG. 5 shows another result of the stress analysis. In FIG. 5, the tube 1 is applied with the inner pressure of 30 MPa. Even in this case, the withstand pressure of the partition portion is substantially equal to that of the circumferential portion in a case where the optimum ratio of Ht/Wt is 0.7.

Here, if the thickness Ht becomes larger than the optimum ratio of Ht/Wt=0.7, the weight of the tube 1 becomes larger although the withstand pressure of the tube 1 is not changed. Therefore, the weight saving of the tube 1 is prevented. On the other hand, if the distance Wt becomes larger than the optimum ratio of Ht/Wt=0.7, the weight of the tube 1 becomes larger although the withstand pressure of the tube 1 is not changed. Therefore, the weight saving of the tube 1 is prevented.

Next, characteristics of the present invention are described as follows. The actual relationship between the distance Wt and the thickness Ht is set to be:

$$0.42 \leqq Ht/Wt \leqq 0.98.$$

In this case, the actual ratio of Ht/Wt is within almost ±40% (i.e., in a range between +40% and −40%) of the optimum ratio of Ht/Wt=0.7. Therefore, the tube 1 becomes light weight and has sufficient high withstand pressure.

Preferably, the actual relationship between the distance Wt and the thickness Ht is set to be 0.56≦Ht/Wt≦0.84. In this case, the actual ratio of Ht/Wt is within almost ±20% (i.e., in a range between +20% and −20%) of the optimum ratio of Ht/Wt=0.7. Therefore, the weight of the tube 1 becomes much lighter and the tube 1 has sufficient high withstand pressure.

More preferably, the actual relationship between the distance Wt and the thickness Ht is set to be 0.63≦Ht/Wt≦0.77. In this case, the actual ratio of Ht/Wt is within almost +10% (i.e., in a range between ±10% and −10%) of the optimum ratio of Ht/Wt=0.7.

The optimum distance Wt of the tube 1 disposed on the high-pressure side heat exchanger defined as Wt=(1.21−0.006×S)×Dp is obtained as follows. When the tube 1 has the thickness Ht and the distance Wt having the optimum ratio of Ht/Wt=0.7, the breaking strength of the tube 1 is determined by both of the diameter Dp and the distance Wt or both of the thickness Ht and the tensile strength S. It is required to have the breaking strength of 40 MPa for the tube 1 disposed in the high-pressure side heat exchanger in the $CO_2$ refrigerant cycle. In view of the stress analysis shown in FIG. 4, the optimum distance Wt is obtained as:

$$Wt=(1.21-0.006\times S)\times Dp.$$

Here, in FIG. 4, for example, when the tensile strength S is 50 N/mm$^2$ and the diameter Dp is 0.4 mm, the minimum distance Wt is 0.364 mm, which is the intersection of the dotted line a3 in FIG. 4. The thickness Ht is obtained by the above formula and the relationship of the optimum ratio of Ht/Wt=0.7.

The actual relationship between the distance Wt, the diameter Dp and the tensile strength S in the tube 1 disposed on the high pressure side of the $CO_2$ refrigerant cycle is set to be:

$$(0.73-0.0036\times S)\times Dp \leqq Wt \leqq (1.69-0.0084\times S)\times Dp.$$

In this case, the actual distance Wt is within almost ±40% (i.e., in a range between +40% and −40%) of the optimum distance Wt defined as Wt=(1.21−0.006×S)×Dp. Therefore, the tube 1 becomes light weight and has sufficient high withstand pressure. Specifically, the tube 1 has the sufficient withstand pressure on the high-pressure side of the $CO_2$ refrigerant cycle.

Preferably, the actual relationship between the distance Wt, the diameter Dp and the tensile strength S is set to be (0.97−0.0048×S)×Dp≦Wt≦(1.45−0.0072×S)×Dp. In this case, the actual distance Wt is within almost ±20% (i.e., in a range between ±20% and −20%) of the optimum distance Wt of Wt=(1.21−0.006×S)×Dp . Therefore, the weight of the tube 1 becomes much lighter and the tube 1 has sufficient high withstand pressure.

More preferably, the actual relationship between the distance Wt, the diameter Dp and the tensile strength S is set to be (1.09−0.0054×S)×Dp≦Wt≦(1.33−0.0066×S)×Dp. In this case, the actual distance Wt is within almost ±10% (i.e., in a range between +10% and −10%) of the optimum distance Wt of Wt=(1.21−0.006×S)×Dp.

The optimum distance Wt of the tube 1 disposed on the low-pressure side heat exchanger defined as Wt=(0.57−0.004×S)×Dp+0.1 is obtained as follows. When the tube 1 has the thickness Ht and the distance Wt having the optimum ratio of Ht/Wt=0.7, the breaking strength of the tube 1 is determined by both of the diameter Dp and the distance Wt or both of the thickness Ht and the tensile strength S. It is required to have the breaking strength of 30 MPa for the tube 1 disposed in the low-pressure side heat exchanger in the $CO_2$ refrigerant cycle. In view of the stress analysis shown in FIG. 5, the optimum distance Wt is obtained as:

$$Wt=(0.57-0.004\times S)\times Dp+0.1.$$

Here, in FIG. 5, for example, when the tensile strength S is 50 $N/mm^2$ and the diameter Dp is 0.4 mm, the minimum distance Wt is 0.248 mm, which is the intersection of the dotted line b3 in FIG. 5. The thickness Ht is obtained by the above formula and the relationship of the optimum ratio of Ht/Wt=0.7.

The actual relationship between the distance Wt, the diameter Dp and the tensile strength S in the tube 1 disposed on the low-pressure side of the $CO_2$ refrigerant cycle is set to be:

$$(0.34-0.0024\times S)\times Dp+0.06 \leqq Wt \leqq (0.80-0.0056\times S)\times Dp+0.14.$$

In this case, the actual distance Wt is within almost ±40% (i.e., in a range between +40% and −40%) of the optimum distance Wt defined as Wt=(0.57−0.004×S)×Dp+0.1. Therefore, the tube 1 becomes light weight and has sufficient high withstand pressure. Specifically, the tube 1 has the sufficient withstand pressure on the low-pressure side of the $CO_2$ refrigerant cycle.

Preferably, the actual relationship between the distance Wt, the diameter Dp and the tensile strength S is set to be (0.46−0.0032×S)×Dp+0.08≦*Wt*≦(0.68−0.0048×S)×Dp+0.12. In this case, the actual distance Wt is within almost ±20% (i.e., in a range between +20% and −20%) of the optimum distance Wt of Wt=(0.57−0.004×S)×Dp+0.1. Therefore, the weight of the tube 1 becomes much lighter and the tube 1 has sufficient high withstand pressure.

More preferably, the actual relationship between the distance Wt, the diameter Dp and the tensile strength S is set to be (0.51−0.0036×S)×Dp+0.09≦Wt≦(0.63−0.0044×S)×Dp+0.11. In this case, the actual distance Wt is within almost ±10% (i.e., in a range between +10% and −10%) of the optimum distance Wt of Wt=(0.57−0.004×S)×Dp+0.1.

Here, when the tube 1 is actually designed, it is required to add additional thickness of the tube 1 for compensating a manufacturing tolerance and/or for increasing the withstand pressure so that the tube 1 has sufficient withstand pressure even if the tube 1 would be corroded. The additional thickness of the tube 1 is added on the calculated thickness having the minimum withstand pressure. In general, the additional thickness of the tube 1 is in a range between +0.05 mm and +0.25 mm. Specifically, the amended thickness Ht' and the amended distance Wt' are defined as:

$$Ht+0.05 \leqq Ht' \leqq Ht+0.25, \text{ and}$$

$$Wt+0.05 \leqq Wt' \leqq Wt+0.25.$$

Here, the optimum ratio of ratio of Ht/Wt is 0.7. Therefore, summarizing the above relations of the amended distance Wt' and the amended thickness Ht', the following relationship is obtained as:

$$0.7\times(Wt'-0.25)+0.05 \leqq Ht' \leqq 0.7\times(Wt'-0.05)+0.25.$$

Therefore, the amended ratio of Ht'/Wt' is defined as:

$$0.7-0.125/Wt' \leqq Ht/Wt' \leqq 0.7+0.215/Wt'.$$

For example, when the distance Wt' is 1 mm, the ratio of Ht'/Wt' is 0.575≦Ht'/Wt'≦0.915.

The tube 1 is made of aluminum-based material having the tensile strength S in a range between 50 $N/mm^2$ and 130 $N/mm^2$. The diameter Dp of the fluid path 2 is set in a range between 0.4 mm and 2.0 mm. When the tube 1 has the above tensile strength S and the fluid path 2, the tube 1 has a sufficient withstand strength of the pressure in the $CO_2$ refrigerant cycle.

In the first embodiment, the distance Wt, the thickness Ht, the diameter Dp, the tensile strength S and the total thickness H are determined into certain values, or when the cross section of the tube 1 is determined to have a certain cross section, the tube 1 becomes light weight and has sufficient high withstand pressure by utilizing the above relationship.

Thus, the heat exchange tube 1 with multiple fluid paths 2 having a perfect circular cross section has high withstand pressure. Further, the weight of the tube 1 becomes light.

Second Embodiment

Figure 6A:
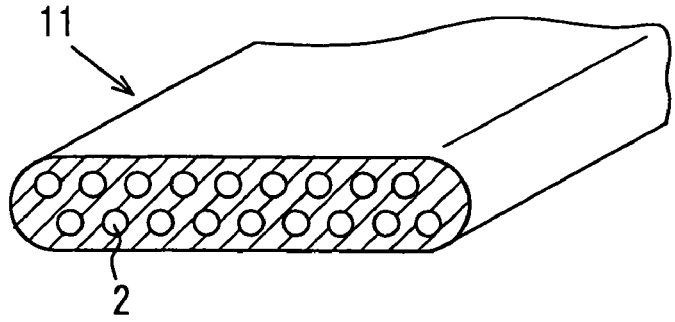
FIG. 6A is a schematic perspective view showing a heat exchange tube.
Figure 6B:
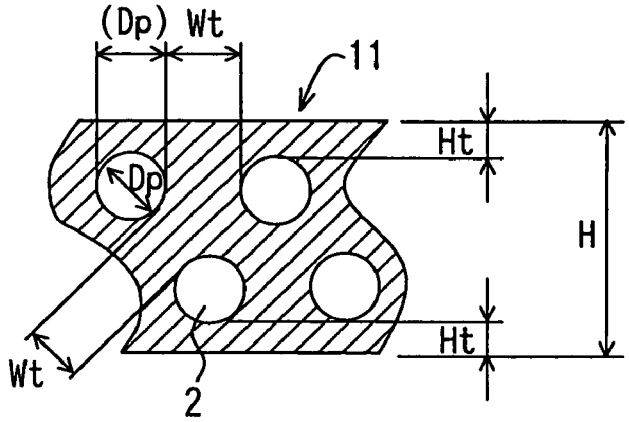
FIG. 6B is a partially enlarged cross sectional view showing the heat exchange tube according to a second embodiment of the present invention.

Another heat exchange tube 11 according to a second embodiment of the present invention is shown in FIGS. 6A and 6B. The tube 11 has multiple fluid paths 2 aligned in a thickness direction (i.e., a height direction) of the tube 11. The neighboring two lines of the fluid paths 2 adjacent in the thickness direction are disposed alternately in the latitudinal direction of the tube 11. Thus, the formability of the tube 11 is improved. Further, when the withstand pressure of the tube 11 is constant, the cross section of the fluid path 2 can become larger although the total cross section of the tube 11 becomes minimum. Thus, the tube 11 has minimum dimensions, light weight, high performance and low manufacturing cost.

Third Embodiment

Figure 7:
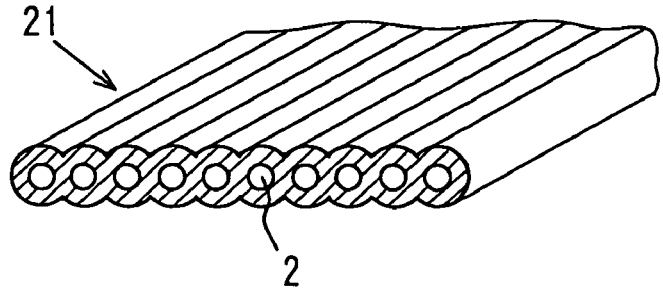
FIG. 7 is a schematic perspective view showing a heat exchange tube according to a third embodiment of the present invention.
Figure 8:
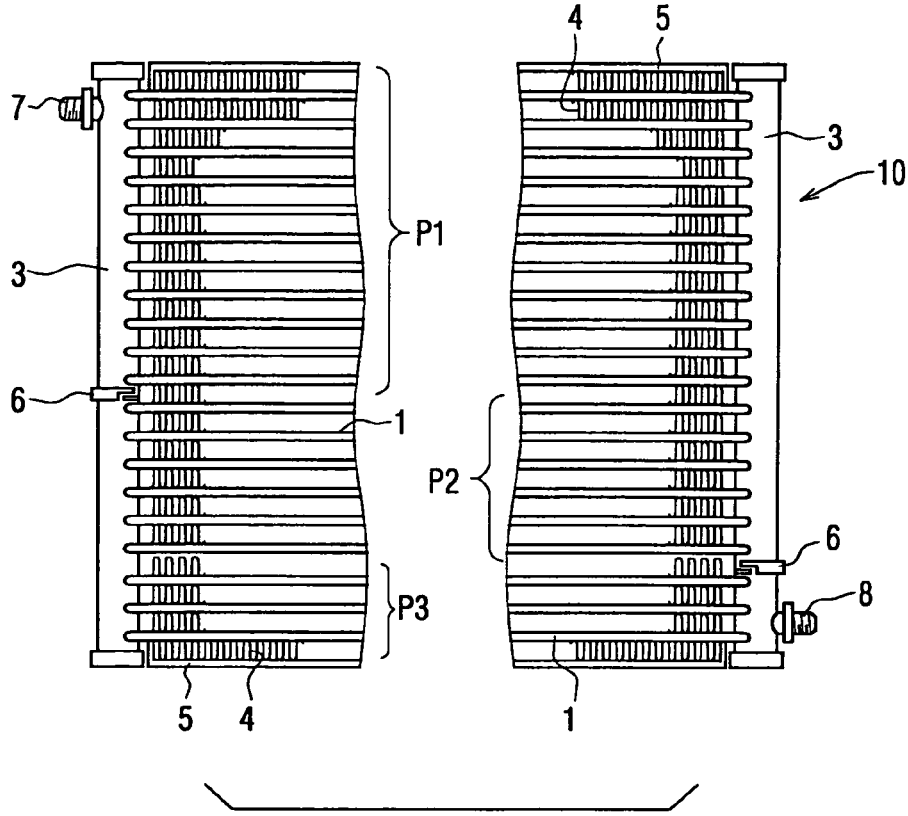
FIG. 8 PRIOR ART
FIG. 8 is a plan view showing a multi-flow type heat exchanger according to a prior art.
Figure 9:
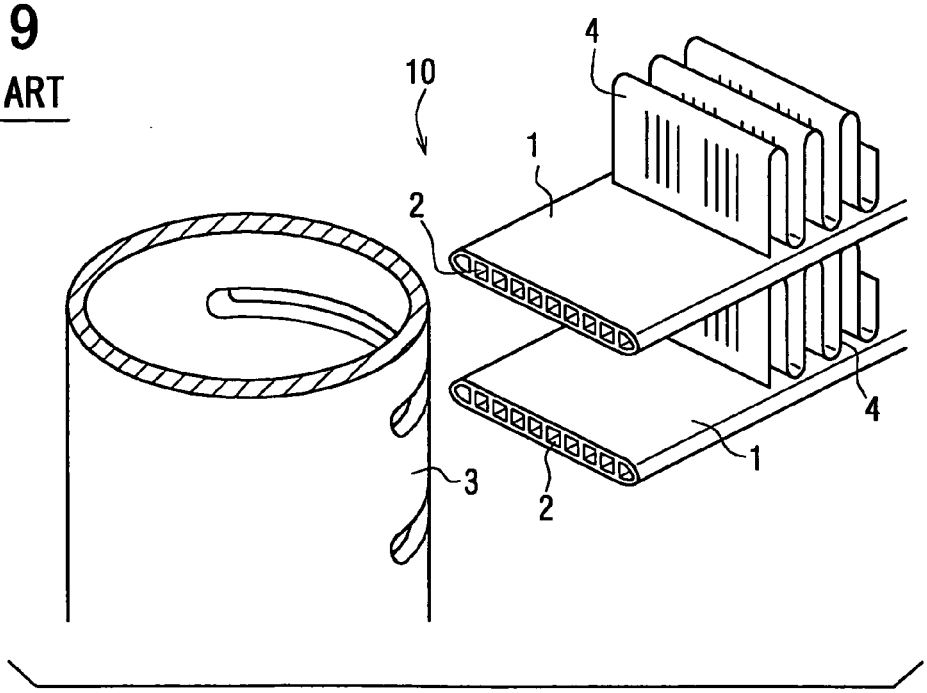
FIG. 9 PRIOR ART
FIG. 9 is an exploded perspective view showing a heat exchange tube and a header in the heat exchanger according to the prior art.

Further another heat exchange tube 21 according to a third embodiment of the present invention is shown in FIG. 7. The circumference of the tube 21 is formed to have a concavity and a convexity in accordance with the fluid path 2. Thus, the weight of the tube 21 is much reduced without decreasing the withstand pressure. That is, the material composing the tube 21 is much reduced.

Such changes and modifications are to be understood as being within the scope of the present invention as defined by the appended claims.

What is claimed is:

1. A single heat exchange tube having a flat shape comprising:

a plurality of fluid paths having a circular cross section extending in a longitudinal direction of the tube, the plurality of fluid paths being parallel with each other;

wherein the tube has a distance between two adjacent fluid paths in the heat exchange tube defined as Wt, and a circumferential thickness between an outer surface of the heat exchange tube and an inner surface of an outermost fluid path is defined as Ht, wherein the distance Wt and the circumferential thickness Ht have a relationship as:

$$0.63 \leqq Ht/Wt \leqq 0.77;$$

wherein the tube is used for a high-pressure side heat exchanger in a vapor-compression refrigerant cycle with $CO_2$ refrigerant, wherein each of the fluid paths has a diameter defined as Dp, wherein the tube is made of material having a tensile strength defined as S, and wherein the relationship among the distance Wt, the tensile strength S and the diameter Dp is defined as:

$$(0.73-0.0036\times S)\times Dp \leqq Wt \leqq (1.69-0.0084\times S)\times Dp.$$

2. The tube according to claim 1, wherein the fluid paths are aligned in a line along with a latitudinal direction of the tube.

3. The tube according to claim 2, wherein the tube includes a circumferential surface having a concavity and a convexity corresponding to the fluid path.

4. The tube according to claim 1, wherein the fluid paths are aligned in multiple lines along with a latitudinal direction of the tube, and wherein two adjacent fluid paths disposed in two adjacent lines, respectively, are disposed alternately.

5. The tube according to claim 4, wherein the tube includes a circumferential surface having a concavity and a convexity corresponding to the fluid path.

6. The tube according to claim 1, wherein the relationship among the distance Wt, the tensile strength S and the diameter Dp is defined as:

$$(0.97-0.0048\times S)\times Dp \leqq Wt \leqq (1.45-0.0072\times S)\times Dp.$$

7. The tube according to claim 1, wherein the relationship among the distance Wt, the tensile strength S and the diameter Dp is defined as:

$$(1.09-0.0054\times S)\times Dp \leqq Wt \leqq (1.33-0.0066\times S)\times Dp.$$

8. The tube according to claim 1, wherein the tensile strength S is in a range between 50N/$mm^2$ and 130N/$mm^2$, and wherein the tube is made of aluminum based material.

9. The tube according to claim 1, wherein the diameter Dp is in a range between 0.4 mm and 2.0 mm.

10. A single heat exchange tube having a flat shape comprising:

a plurality of fluid paths having a circular cross section extending in a longitudinal direction of the tube, the plurality of fluid paths being parallel with each other;

wherein the tube has a distance between two adjacent fluid paths in the heat exchange tube defined as Wt, and a circumferential thickness between an outer surface of the heat exchange tube and an inner surface of an outermost fluid path is defined as Ht, wherein the distance Wt and the circumferential thickness Ht have a relationship as:

$$0.63 \leqq Ht/Wt \leqq 0.77;$$

wherein the tube is used for a low-pressure side heat exchanger in a vapor-compression refrigerant cycle with $CO_2$ refrigerant, wherein each of the fluid paths has a diameter defined as Dp, wherein the tube is made of material having a tensile strength defined as S, and wherein the relationship among the distance Wt, the tensile strength S and the diameter Dp is defined as:

$$(0.34-0.0024\times S)\times Dp+0.06 \leqq Wt \leqq (0.80-0.0056\times S)\times Dp+0.14.$$

11. The tube according to claim 10, wherein the relationship among the distance Wt, the tensile strength S and the diameter Dp is defined as:

$$(0.46-0.0032\times S)\times Dp+0.08 \leqq Wt \leqq (0.68-0.0048\times S)\times Dp+0.12.$$

12. The tube according to claim 10, wherein the relationship among the distance Wt, the tensile strength S and the diameter Dp is defined as:

$$(\mathbf{0.51-0.0036}\times S)\times Dp+0.09 \leqq Wt \leqq (0.63-0.0044\times S)\times Dp+0.11.$$

13. The tube according to claim 10, wherein the tensile strength S is in a range between 50N/$mm^2$ and 130N/$mm^2$, and wherein the tube is made of aluminum based material.

14. The tube according to claim 10, wherein the diameter Dp is in a range between 0.4 mm and 2.0 mm.

* * * * *